US007287592B2

(12) United States Patent
Surjaatmadja et al.

(10) Patent No.: US 7,287,592 B2
(45) Date of Patent: Oct. 30, 2007

(54) LIMITED ENTRY MULTIPLE FRACTURE AND FRAC-PACK PLACEMENT IN LINER COMPLETIONS USING LINER FRACTURING TOOL

(75) Inventors: Jim B. Surjaatmadja, Duncan, OK (US); Billy W. McDaniel, Duncan, OK (US); Porter Underwood, Bakersfiled, CA (US)

(73) Assignee: Halliburton Energy Services, Inc., Duncan, OK (US)

( * ) Notice: Subject to any disclaimer, the term of this patent is extended or adjusted under 35 U.S.C. 154(b) by 357 days.

(21) Appl. No.: 10/866,362

(22) Filed: Jun. 11, 2004

(65) Prior Publication Data

US 2005/0274522 A1 Dec. 15, 2005

(51) Int. Cl.
*E21B 43/26* (2006.01)

(52) U.S. Cl. ..... 166/308.1; 166/177.5; 166/376

(58) Field of Classification Search ..... 166/376, 166/308.1, 177.5, 298
See application file for complete search history.

(56) References Cited

U.S. PATENT DOCUMENTS

| | | | | |
|---|---|---|---|---|
| 3,130,786 | A * | 4/1964 | Brown et al. | 175/424 |
| 3,391,737 | A * | 7/1968 | Havens | 166/289 |
| 4,808,925 | A | 2/1989 | Baird | 324/221 |
| 4,951,751 | A | 8/1990 | Jennings | 166/285 |
| 5,117,912 | A | 6/1992 | Young | 166/305.1 |
| 5,363,919 | A | 11/1994 | Jennings | 166/308 |
| 5,381,864 | A | 1/1995 | Nguyen et al. | 166/280 |
| 5,406,078 | A | 4/1995 | Jacobson | 250/261 |
| 5,743,334 | A | 4/1998 | Nelson | 166/250.07 |
| 5,765,642 | A | 6/1998 | Surjaatmadja | 166/297 |
| 5,894,888 | A * | 4/1999 | Wiemers et al. | 166/250.1 |
| 5,899,958 | A | 5/1999 | Dowell et al. | 702/6 |
| 5,941,308 | A | 8/1999 | Malone | 166/313 |
| 6,006,838 | A | 12/1999 | Whiteley et al. | 166/306 |
| 6,012,525 | A | 1/2000 | Burleson et al. | 166/297 |
| 6,116,343 | A | 9/2000 | van Petegem et al. | 166/297 |
| 6,230,805 | B1 | 5/2001 | Vercaemer et al. | 166/300 |
| 6,257,338 | B1 | 7/2001 | Kilgore et al | 166/387 |
| 6,286,598 | B1 | 9/2001 | van Petegem et al. | 166/297 |
| 6,286,600 | B1 | 9/2001 | Hall et al. | 166/305.1 |
| 6,306,800 | B1 | 10/2001 | Samuel et al. | 507/129 |
| 6,394,184 | B2 | 5/2002 | Tolman et al. | 166/281 |

(Continued)

OTHER PUBLICATIONS

"SurgiFrac[SM] Service Fracture Stimulation Technique for Horizontal Completions in Low-to-Medium-Permeability Reservoirs." Halliburton Communications, Feb. 2003.

(Continued)

*Primary Examiner*—William Neuder
*Assistant Examiner*—Nicole Coy
(74) *Attorney, Agent, or Firm*—John W. Wustenberg; Baker Botts, L.L.P.

(57) ABSTRACT

The present invention is directed to a method and apparatus for fracturing a subterranean formation which use a liner fracturing tool. The liner fracturing tool consists of a liner, with at least one jet extending through the liner. During fracturing operations, fracturing fluid is pressured through the jet to form microfractures. Fractures are formed by the stagnation pressure of the fracturing fluid. The jets may be mounted within a jet holder that may be dissolved following fracturing operations to allow reservoir hydrocarbons to flow into the liner more readily.

17 Claims, 2 Drawing Sheets

U.S. PATENT DOCUMENTS

| | | | | |
|---|---|---|---|---|
| 6,494,260 | B2 | 12/2002 | van Petegem et al. | 166/278 |
| 6,497,284 | B2 | 12/2002 | van Petegem et al. | 166/297 |
| 6,508,307 | B1 | 1/2003 | Almaguer | 166/308 |
| 6,520,255 | B2 | 2/2003 | Tolman et al. | 166/281 |
| 6,543,538 | B2 | 4/2003 | Tolman et al. | 166/284 |
| 6,547,011 | B2 | 4/2003 | Kilgore | 166/387 |
| 6,554,075 | B2 | 4/2003 | Fikes et al. | 166/379 |
| 6,601,646 | B2 | 8/2003 | Streich et al. | 166/278 |
| 6,604,581 | B2 | 8/2003 | Moake et al. | 166/250.07 |
| 6,644,110 | B1 | 11/2003 | Curtis et al. | 73/152.51 |
| 2003/0070811 | A1* | 4/2003 | Robison et al. | 166/298 |
| 2005/0121193 | A1* | 6/2005 | Buchanan et al. | 166/281 |
| 2005/0263284 | A1* | 12/2005 | Justus | 166/281 |

OTHER PUBLICATIONS

"CobraJet Frac$^{SM}$ Service Cost-effective Technology That Can Help Reduce Cost Per BOE Produced, Shorten Cycle Time and Reduce Capex," Halliburton Communications, undated.

"CobraFrac$^{SM}$ Service Coiled Tubing Fracturing—Cost-Effective Method for Stimulating Untapped Reserves," Halliburton Energy Services, Inc, Dec. 2000.

L. W. Knowlton, Empire Exploration Inc., "Depth Control for Openhole Frac Procedure," SPE Paper 21294, 1990.

Michael L. Connell, et al., "High-Pressure/High-Temperature Coiled Tubing Casing Collar Locator Provides Accurate Depth Control for Single-Trip Perforating," SPE Paper 60698, 2000.

Michael L. Connell, et al., "Development of a Wireless Coiled Tubing Collar Locator," SPE Paper 54327, 1999.

G. Rodvelt, et al., "Multiseam Coal Stimulation Using Coiled-Tubing Fracturing and a Unique Bottomhole Packer Assembly," SPE Paper 72380, 2001.

M. J. Granger, et al., "Horizontal Well Applications in the Guymon-Hugoton Field: A Case Study," SPE Paper 35641, 1995.

J. K. Flowers, et al., "Solutions to Coiled Tubing Depth Control," SPE Paper 74833, 2002.

* cited by examiner

LIMITED ENTRY MULTIPLE FRACTURE AND FRAC-PACK PLACEMENT IN LINER COMPLETIONS USING LINER FRACTURING TOOL

BACKGROUND

The present invention relates generally to an improved method and system for fracturing a subterranean formation to stimulate the production of desired fluids therefrom.

Hydraulic fracturing is often utilized to stimulate the production of hydrocarbons from subterranean formations penetrated by wellbores. Typically, in performing hydraulic fracturing treatments, the well casing, where present, such as in vertical sections of wells adjacent the formation to be treated, is perforated. Where only one portion of a formation is to be fractured as a separate stage, it is isolated from the other perforated portions of the formation using conventional packers or the like, and a fracturing fluid is pumped into the wellbore through the perforations in the well casing and into the isolated portion of the formation to be stimulated at a rate and pressure such that fractures are formed and extended in the formation. Propping agent may be suspended in the fracturing fluid which is deposited in the fractures. The propping agent functions to prevent the fractures from closing, thereby providing conductive channels in the formation through which produced fluids can readily flow to the wellbore. In certain formations, this process is repeated in order to thoroughly populate multiple formation zones or the entire formation with fractures.

Wellbores having horizontal or highly inclined portions present a unique set of problems for fracturing. For instance, in many horizontal or highly inclined wellbores sections the wellbore has no casing or the annulus between the pipe and formation may not be filled with cement. In such completions, it may be difficult or impossible to effectively isolate portions of the formation in order to effectively fracture the formation. In other cases where solid pipe has been used in the horizontal or highly inclined wellbore section, fluid may exit the solid pipe section to a non-cemented annulus. In such situations, control of fracture placement or the number of fractures may be difficult.

Even with cemented casings, these typical techniques are not without problems. Fracturing certain formations may require multiple repositioning and multiple placement of conventional packers and fracturing equipment to properly fracture the entire formation. Such activities often result in delay, and therefore additional expense, as downhole equipment is repositioned and the formation repeatedly fractured. In addition, each time packers are repositioned, there are risks that packers may unseat or leak, possibly resulting in unsuccessful fracture treatment, tool damage, and loss of well control. Further, it may be desirable to fracture the entire formation in a single operation, for instance to reduce costs. In addition, when horizontal sections of wells are fractured, there is usually a tendency for most of the created fractures to be concentrated at areas that are weaker or may have been mechanically damaged during the drilling process. Quite often, such concentrated fracturing occurs near the turn in the well from the vertical to the horizontal section. In some instances, concentrated fracturing may be located near naturally-occurring weak zones due to the non-homogeneous nature of many reservoir rocks. This may result in inadequate stimulation of the well due to failure to fracture along the entire formation and may greatly reduce overall well production compared to the potential production had the producing zones of the formation been more completely fracture-stimulated.

SUMMARY

The present invention is directed to an apparatus and method for effectively fracturing multiple regions or zones in a formation in a controlled manner.

More specifically, one embodiment of the present invention is directed to a method of fracturing a subterranean formation penetrated by a wellbore by first positioning a liner fracturing tool within the wellbore to form an annulus between the liner fracturing tool and the wellbore. The liner fracturing tool has a liner outer wall, one or more jets, an upstream portion, a downstream portion and a fluid passageway. The jets of the liner fracturing tool in one embodiment are hollow and extend through the liner outer wall into the wellbore forming nozzles. The jets are capable of allowing fluid to flow from the fluid passageway to the subterranean formation. A fracturing fluid is introduced into the fluid passageway of the liner fracturing tool and fracturing fluid is jetted through at least some of the nozzles against the subterranean formation at a pressure sufficient to form cavities in the formation, which are in fluid communication with the wellbore. The fracturing fluid is maintained in the cavities at a sufficient static pressure while jetting to fracture the subterranean formation.

Another embodiment of the present invention is directed to a liner fracturing apparatus with a liner, wherein the liner has an outer wall, an interior fluid passageway, and at least one port in the outer wall. The liner fracturing apparatus also has one or more jets, wherein the jets are mounted within the ports and extend through the outer surface of the liner, forming nozzles.

Still another embodiment of the present invention is directed to a liner fracturing tool having a liner with an outer wall, an interior fluid passageway, and one or more ports in the outer wall, a jet holder that is mounted within the port or ports, and one or more jets that are mounted within at least one jet holder and extend beyond the outer surface of the liner, forming at least one nozzle.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings.

DETAILED DESCRIPTION

In wells penetrating certain formations, and particularly deviated wells, it is often desirable to create relatively small fractures referred to in the art as "microfractures" in the formations near the wellbores to facilitate creation of hydraulically induced enlarged fractures. In accordance with the present invention, such microfractures are formed in subterranean well formations utilizing a liner fracturing tool having at least one fluid jet.

The liner fracturing tool is positioned within a formation to be fractured, and fluid is then jetted through the fluid jet against the formation at a pressure sufficient to form a cavity therein and fracture the formation by stagnation pressure in the cavity. A high stagnation pressure is produced at the tip of a cavity in a formation to be fractured because of the jetted fluids being trapped in the cavity as a result of having to flow out of the cavity in a direction generally opposite to the direction of the incoming jetted fluid. The high pressure exerted on the formation at the tip of the cavity causes a microfracture to be formed and extended a short distance into the formation.

In order to extend a microfracture formed as described above further into the formation in accordance with this invention, additional fluid is pumped from the surface into the wellbore to raise the ambient fluid pressure exerted on the formation while the formation is being jetted by the fluid jet or jets produced by the hydrajetting tool. The fluid in the wellbore flows into the cavity produced by the fluid jet and flows into the fracture at a rate and high pressure sufficient to extend the fracture an additional distance from the wellbore into the formation.

Figure 1:
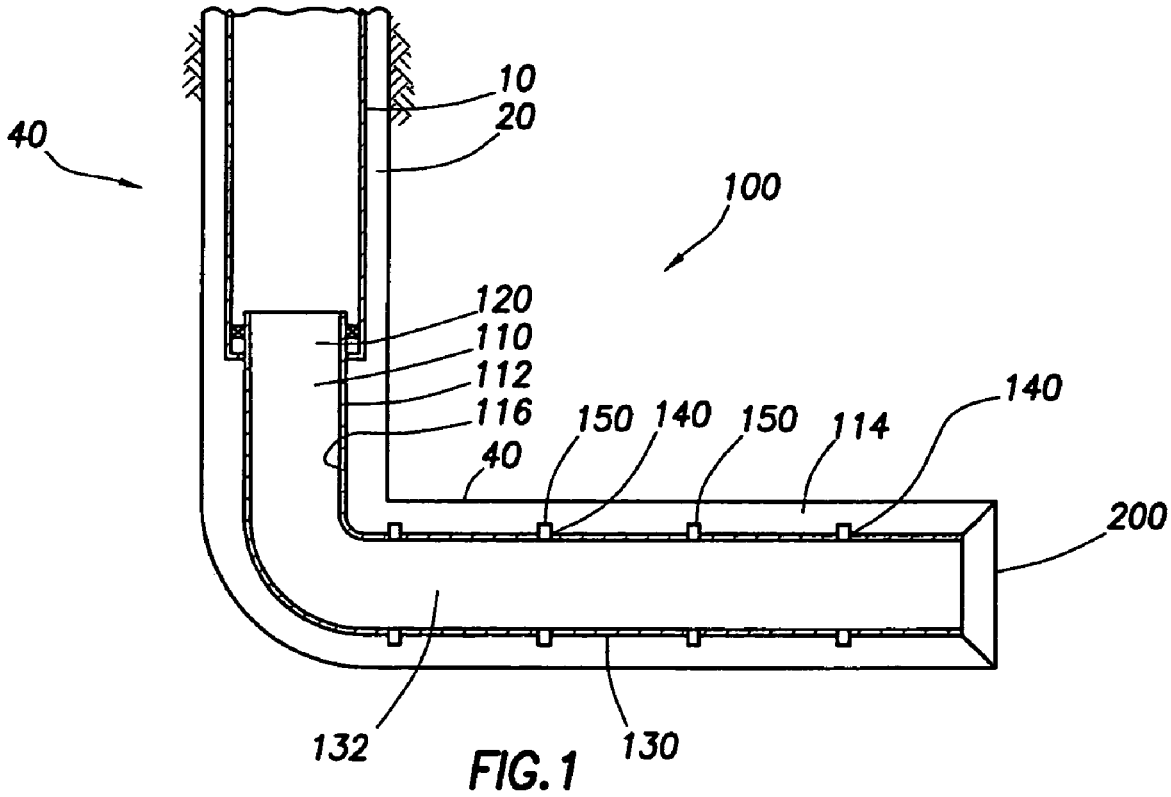
FIG. 1 is a perspective view of one embodiment of a liner fracturing tool for fracturing multiple regions or zones in a formation according to the present invention.
Figure 1A:
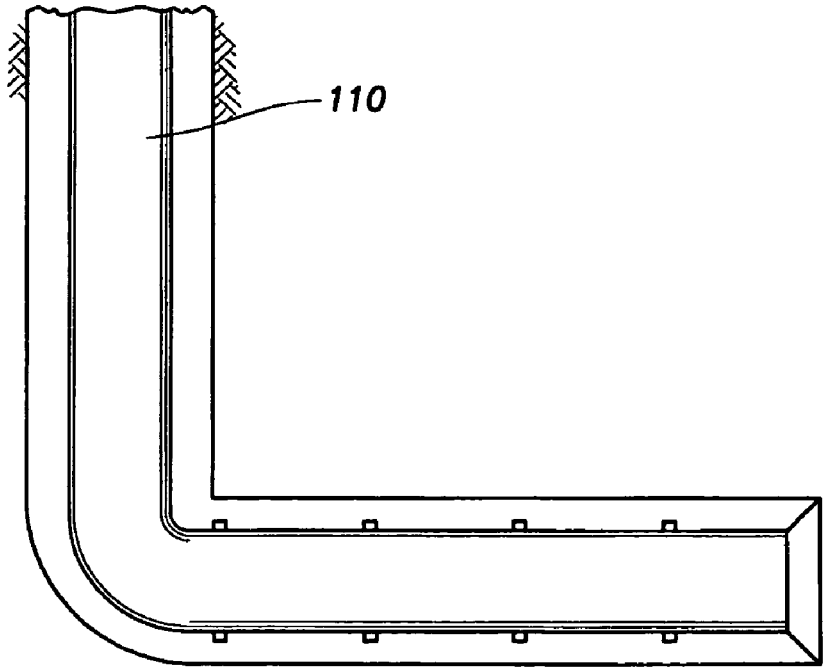
FIG. 1A is a perspective view of an alternate embodiment of a liner fracturing tool according to the present invention.

The details of the present invention will now be described with reference to the accompanying drawings. Turning to FIG. 1, a liner fracturing tool in accordance with the present invention is shown generally by reference numeral 100. Liner fracturing tool 100 includes a liner 110, which is generally cylindrical in shape and has liner outer wall 112 and liner inner wall 116. Liner 110 is designed to fit within wellbore 20. Wellbore 20 extends through formation 40. In the embodiment depicted in FIG. 1, liner 110 has a mostly-vertical liner section 120 and a mostly-horizontal liner section 130. In at least one embodiment, liner 110 is hung from casing 10, as shown in FIG. 1. A "liner" is generally a casing string that does not extend to the top of the wellbore, but instead is anchored or suspended from inside the bottom of the previous casing string. "Casing" generally extends to the top of the wellbore. "Tubing," such as jointed rigid coiled tubing, is generally pipe string that may be used to produce hydrocarbons from the reservoir, such as production tubing, or is used during well completion, such as that used in bullhead stimulation operations. For purposes of the present invention, "liner" is defined to include the casing string suspended from the bottom of the previous casing string which may be cemented in place, "casing" and "tubing." Thus, as shown in FIG. 1A, liner 110 may extend from the surface through wellbore 20. As further depicted in FIG. 1, annulus 114 is formed between liner outer wall 112 of mostly-horizontal liner section 130 and wellbore 20, as shown in FIG. 1. Fluid passageway 132 extends axially through liner 110.

In one embodiment of the present invention, one or more ports 140 extend from liner inner wall 116 through liner outer wall 112 of mostly-horizontal liner section 130. Ports 140 are generally approximately circular openings, although other shapes may be used depending on the particular design parameters. Ports 140 are designed to allow the mounting of jets 150 within ports 140, and optionally, as further shown in FIGS. 2 and 4, jet holders 160. The present invention includes one or more jets 150. Jets 150 are designed to allow fluid flow from fluid passageway 132 through liner inner wall 116 and liner outer wall 112. Jets 150 are further designed to cause fluid impingement on formation 40. Jets 150 may also be designed in some embodiments to allow hydrocarbon flow from formation 40 to fluid passageway 132. Jets 150 may extend beyond the surface of liner 110. In an exemplary embodiment where jets 150 extend beyond liner 110, jets 150 are approximately cylindrical, hollow projections that may be in a single line orientation, but may more commonly be oriented at an angle between about 30° and about 90° from liner outer wall 112 more preferably between about 45° and about 90°. Jets 150 terminate in nozzle 170, shown in FIG. 4, which is an opening that will allow fluid to exit jets 150 and reach formation 40. Jets 150 may be composed of any material that is capable of withstanding the stresses associated with fluid fracture of formation 40 and the abrasive nature of the fracturing or other treatment fluid and any proppants or other fracturing agents used. Non-limiting examples of an appropriate material of construction of jets 150 are tungsten carbide and certain ceramics.

Figure 2:
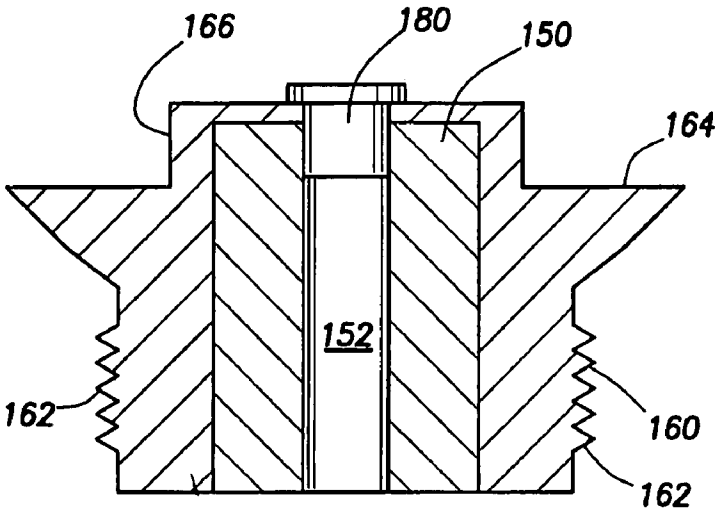
FIG. 2 is an expanded view of one embodiment of a jet and jet holder according to the present invention.
Figure 4:
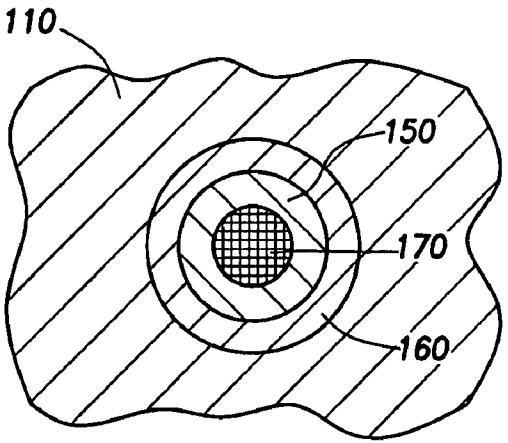
FIG. 4 is an expanded view depicting a jet, jet holder, and nozzle according to the present invention.

In an alternative embodiment, jet holders 160, shown in FIGS. 2 and 4, are used. Jet holders 160 are mounted within ports 140 and are designed to receive jets 150. Jet holders 160, when used, are typically composed of a material capable of being dissolved such as in a solvent fluid, acid, or water. One non-limiting example of a suitable material for jet holders 160 is aluminum. Another example of a suitable material for jet holders 160 is polylactic acid (PLA). Jet holders 160 may also be composed of a more durable material such as steel. When jet holders 160 are composed of a more durable material, it may be desirable to provide a dissolvable material between jets 150 and jet holders 160. When jet holders 160 are not used, jets 150 are attached directly to the liner by such non-limiting means as welding, soldering, gluing, or threading, although any conventional method of attachment capable of withstanding jetting pressures, as well as the abrasive and corrosive nature of fracturing fluids may be used.

FIG. 2 depicts one embodiment of jets 150 within jet holder 160. Jet holder 160 is shown with threads 162. Threads 162 are designed to threadably engage counterpart threads within ports 140. When jet holders 160 are used, ports 140 and jet holders 160 may be designed to allow threadable engagement of jet holders 160 into ports 140, as shown in FIG. 2, although any conventional method of attachment such as welding or pressing may also be used. Jet passageway 152 extends through jet 150 and is designed to allow fluid to pass from fluid passageway 132, through jet 150 and into wellbore 20. Jet holder projections 164 are depicted in FIG. 2. Jet holder projections 164 are optional and fit into optional recesses on the outer surface of liner 110. Jet holder projections 164 serve to hold jet holders 160 in place. Jet holder extension 166 extends beyond liner outer wall 112. Where jets 150 do not project beyond the liner outer wall 112, jet holder extension 166 is not used and jets 150 and jet holder 150 terminate at liner outer wall 112. Where, as in the embodiment depicted in FIG. 2, jet holder extension 166 is shown to extend beyond the top surface of jet 150, jet passageway 152 extends through jet holder 160 to allow fluid to pass from fluid passageway 132 into wellbore 20.

Jet orientation and location are dependent upon the formation to be fractured, the process of which is described below. Jet orientation may coincide with the orientation of the plane of minimum principal stress, or the plane perpendicular to the minimum stress direction in the formation to be fractured relative to the axial orientation of wellbore 20 penetrating the formation. Jet location along liner 110 may be chosen to optimize formation fracture, i.e., typically to allow formation fracture throughout the portion of formation 40 to be fractured. In particular, one of ordinary skill in the art will recognize the importance of allowing adequate distance between jet 150 positions along the liner to reduce or eliminate intersecting or interfering fractures. Jet circumferential location about liner 110 should be chosen depending on the particular well, field or, formation to be fractured. For instance, in certain circumstances, it may be desirable to orient all jets 150 towards the surface for certain formations or 90° stations about the circumference of liner 110 for other formations. It is further possible to alter the internal diameter of jets 150 dependent upon the location of particular jet 150 along the wellbore, the formation, well, or field. One of ordinary skill in the art may vary these parameters to achieve the most effective treatment for the particular well.

The open end of liner 110 is typically plugged, such as with open-end plug 200 as shown in FIG. 2 or a check valve such that no treatment fluids, for instance the fracturing fluid, may exit through the open end of liner 110. In this way, all treatment fluids exit through jets 150, rather than through the open end of liner 110.

In certain circumstances, it may be desirable to install thermally melting or dissolvable nozzle plugs 180 in nozzle 170 of jets 150 as shown in FIG. 2. Nozzle plugs 100 are designed to fit within nozzle 170. Occasionally, wellbore 20 may contain debris in the horizontal section such as sand or well cuttings. In such circumstances, it may be necessary to "wash in" the liner, i.e., to pump fluid down annulus 114 and up fluid passageway 132 to move the debris out of the well. In order to prevent this fluid from exiting jets 150, jets 150 may be plugged to prevent or reduce fluid flow during the wash-in procedure. Nozzle plugs 180 may be formed from a variety of materials that are designed to be melted or dissolved upon the completion of the wash-in procedure. For instance, nozzle plugs 180 may be formed from a low-melt temperature plastic, i.e., a plastic with a melt temperature below about 250° F., such as various polylactides, polystyrene or linear polyethylene. Alternatively, nozzle plugs 180 may be formed of a dissolvable material including, but not limited to, PLA or metals such as aluminum, but those of skill in the art will recognize a wide variety of dissolvable plug materials may be used depending on particular formations to be fractured and the particular fluids available for use in a particular well. Nozzle plugs 180 formed from metals such as aluminum may be dissolved by acids, including acetic, formic, hydrochloric, hydrofluoric and fluroboric acids. Nozzle plugs 180 formed from PLA degrade in the presence of water at desired temperatures.

In order to fracture a subterranean formation, liner fracturing tool 100 is lowered into wellbore 20 until jets 150 reach the desired formation to be fractured. When nozzle plugs 180 have been installed in nozzles 170, the liner may be washed in if necessary as described above. Following wash in, nozzle plugs 180 may be melted, for instance through the use of a fluid with a temperature above the melting temperature of nozzle plugs 180, or dissolved through the use of an acid wash or other chemical wash so designed as to dissolve the particular material. In some formations, the temperature of the formation may be such as to thermally degrade nozzle plugs 180 over time, thereby melting nozzle plugs 180 after completion of the wash-in procedure.

Fracturing fluid may then be forced through jets 150. The rate of pumping the fluid into liner 110 and through jets 150 is increased to a level whereby the pressure of the fluid which is jetted through jets 150 reaches the jetting pressure sufficient to cause the creation of the cavities 50 and microfractures 52 in the formation 40 as illustrated in FIG. 4.

A variety of fluids can be utilized in accordance with the present invention for forming fractures, including aqueous fluids, viscosified fluids, oil based fluids, and even certain "non-damaging" drilling fluids known in the art. Various additives can also be included in the fluids utilized such as abrasives, fracture propping agent, e.g., sand or artificial proppants, acid to dissolve formation materials and other additives known to those skilled in the art.

As will be described further hereinbelow, the jet differential pressure ($P_{jd}$) at which the fluid must be jetted from jets 150 to result in the formation of the cavities 50 and microfractures 52 in the formation 40 is a pressure of approximately two times the pressure ($P_i$) required to initiate a fracture in the formation less the ambient pressure ($P_a$) in the wellbore adjacent to the formation i.e., $P_{jd} \geqq 2\times(P_1-P_a)$. The pressure required to initiate a fracture in a particular formation is dependent upon the particular type of rock and/or other materials forming the formation and other factors known to those skilled in the art. Generally, after a wellbore is drilled into a formation, the fracture initiation pressure can be determined based on information gained during drilling and other known information. Since wellbores are often filled with drilling fluid and since many drilling fluids are undesired, the fluid could be circulated out, and replaced with desirable fluids that are compatible with the formation. The ambient pressure in the wellbore adjacent to the formation being fractured is the hydrostatic pressure exerted on the formation by the fluid in the wellbore or a higher pressure caused by fluid injection.

When fluid is pumped into the wellbore or liner annulus to increase the pressure to a level above hydrostatic to extend the microfractures as will be described further hereinbelow, the ambient pressure is whatever pressure is exerted in the wellbore on the walls of the formation to be fractured as a result of the pumping.

At a stand-off clearance of about 1.5 inches between the face of the jets 150 and the walls of the wellbore and when the jets formed flare outwardly from their cores at an angle of about 20°, the jet differential pressure required to form the cavities 50 and the microfractures 52 is a pressure of about 2 times the pressure required to initiate a fracture in the formation less the ambient pressure in the wellbore adjacent to the formation. When the stand off clearance and degree of flare of the fluid jets are different from those given above, the following formulas can be utilized to calculate the jetting pressure.

$$Pi=Pf-Ph$$

$$\Delta P/Pi=1.1[d+(s+0.5)\tan(\text{flare})]^2/d^2$$

wherein;

Pi=difference between formation fracture pressure and ambient pressure, psi

Pf=formation fracture pressure, psi

Ph=ambient pressure, psi

ΔP=the jet differential pressure, psi d=diameter of the jet, inches s=stand off clearance, inches flare=flaring angle of jet, degrees As mentioned above, propping agent may be combined with the fluid being jetted so that it is carried into the cavities 50 into fractures 60 connected to the cavities. The propping agent functions to prop open fractures 60 when they attempt to close as a result of the termination of the fracturing process. In order to insure that propping agent remains in the fractures when they close, the jetting pressure is preferably slowly reduced to allow fractures 60 to close on propping agent which is held in the fractures by the fluid jetting during the closure process. In addition to propping the fractures open, the presence of the propping agent, e.g., sand, serves as an abrasive agent and in the fluid being jetted facilitates the cutting and erosion of the formation by the fluid jets. As indicated, additional abrasive material can be included in the fluid, as can one or more acids which react with and dissolve formation materials to enlarge the cavities and fractures as they are formed.

Figure 3:
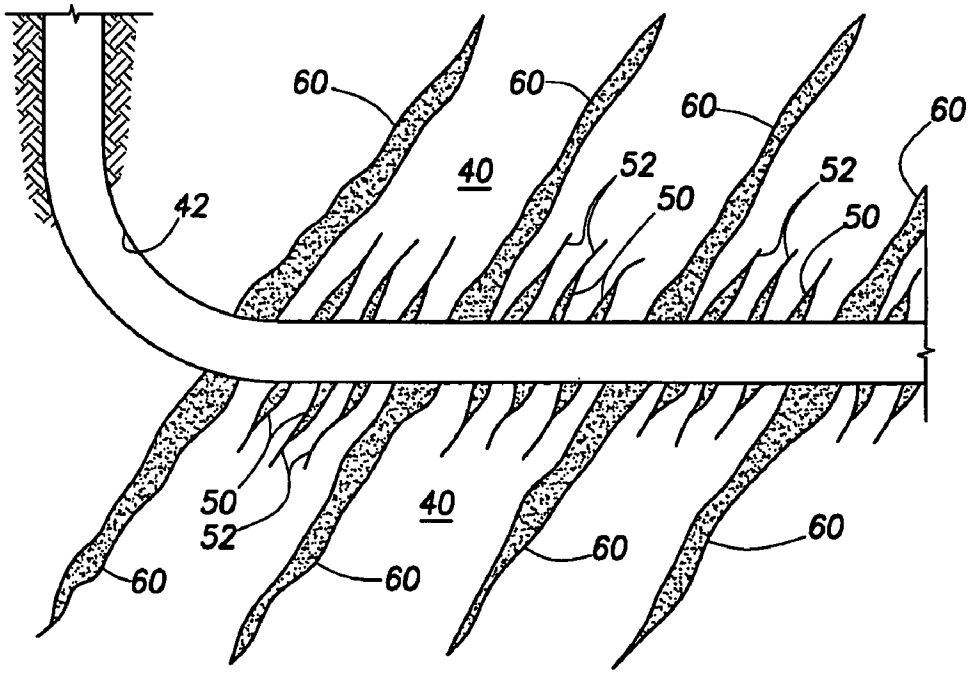
FIG. 3 is a cross-sectional view of the deviated wellbore of FIG. 2 after a plurality of microfractures and extended fractures have been created therein.

As further mentioned above, some or all of the microfractures produced in a subterranean formation can be extended into the formation by pumping a fluid into the wellbore to raise the ambient pressure therein. That is, in carrying out the methods of the present invention to form and extend a fracture in the present invention, liner fracturing tool 100 is positioned in wellbore 20 adjacent the formation 40 to be fractured and fluid is jetted through the jets 150 against the formation 40 at a jetting pressure sufficient to form the cavities 50 and the microfractures 52. Simultaneously with the hydrajetting of the formation, a fluid is pumped into wellbore 20 at a rate to raise the ambient pressure in the wellbore adjacent the formation to a level such that the cavities 50 and microfractures 52 are enlarged and extended whereby enlarged and extended fractures 60 are formed. As shown in FIG. 3, the enlarged and extended fractures 60 are preferably formed in spaced relationship along wellbore 20 with groups of the cavities 50 and microfractures 52 formed therebetween. In situations where wellbore 20 is isolated from the annulus 114 by packers, jetting at higher flow rates could be used to place substantial fractures in formation 40, such as where jetting flow far exceeds the fluid loss in the annulus, allowing the jetting fluid to increase the ambient pressure in annulus 114.

Liner fracturing tool 100 can be operated so as to fracture multiple sites of formation 40 approximately simultaneously, or portions of formation 40 can be fractured at different times. When liner fracturing tool 100 is operated to fracture multiple sites of formation 40 approximately simultaneously, fracturing fluid is pressurized throughout fluid passageway 132 of liner 110. In this way, fracturing fluid reaches all jets 150 approximately simultaneously and microfractures 52 are formed approximately simultaneously. Alternatively, when it is desirable to fracture different portions of formation 40 at different times, fracturing fluid is pressured through only some of jets 150 at any one time. This may be accomplished by installing a straddle packer type device immediately upstream and downstream of the portion of formation 40 to be fractured. Fracturing fluid is then pressured through jets 150 between the upstream and downstream portions of the straddle packer type device. The straddle packer type device may then be moved to a different set of jets 150 and the process repeated as desired. In this way, one portion at a time of formation 40 may be fractured.

Following the fracture of formation 40, the annulus or wellbore may be "packed," i.e., a packing material may be introduced into the fractured zone to reduce the amount of fine particulants such as sand from being produced during the production of hydrocarbons. The process of "packing" is well known in the art and typically involves packing the well adjacent the unconsolidated or loosely consolidated production interval, called gravel packing. In a typical gravel pack completion, a sand control screen is lowered into the wellbore on a workstring to a position proximate the desired production interval. A fluid slurry including a liquid carrier and a relatively coarse particulate material, which is typically sized and graded and which is referred to herein as gravel, is then pumped down the workstring and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

In another embodiment of the present invention, the proppant material, such as sand, is consolidated to better hold it within the microfractures. Consolidation may be accomplished by any number of conventional means, including, but not limited to, introducing a resin coated proppant (RCP) into the microfractures.

In another embodiment of the present invention, following well fracture and any optional packing or consolidating steps, jet holders 160 may be dissolved using acids, such as when using jet holders 160 made of materials such as aluminum. When jet holders 160 are composed of PLA, they will automatically decompose into lactic acid after a designed period of time when exposed to water at desired temperatures. The time period will largely be controlled by the formulation of the PLA material and the ambient temperature around the tool. By dissolving or melting jet holders 160, ports 140 are opened to receive hydrocarbons from the reservoir. Thus, in at least one embodiment of the present invention, during production, hydrocarbons are allowed to flow through ports 140 into liner 110.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of fracturing a subterranean formation penetrated by a wellbore comprising the steps of:

a. positioning a liner fracturing tool within the wellbore to form an annulus between the liner fracturing tool and the wellbore, the liner fracturing tool comprising a liner outer wall, a jet, an upstream portion, a downstream portion and a fluid passageway, wherein the jet is hollow and extends through the liner outer wall forming a nozzle and wherein the jet is capable of allowing fluid to flow from the fluid passageway to the subterranean formation;

b. introducing a fracturing fluid into the fluid passageway of the liner fracturing tool;

c. jetting the fracturing fluid through the nozzle against the subterranean formation at a pressure sufficient to form cavities in the formation, wherein the cavities in the formation are in fluid communication with the wellbore; and d. maintaining the fracturing fluid in the cavities while jetting at a sufficient static pressure to fracture the subterranean formation.

2. The method according to claim 1, wherein the liner fracturing tool comprises a plurality of nozzles and fracturing fluid is jetted through all nozzles approximately simultaneously.

3. The method according to claim 1, comprising prior to step (b):

installing a packer device so as to isolate the upstream portion of the liner from the downstream portion of the liner.

4. The method of claim 3 wherein the packer device is a straddle packer-type device.

5. The method of claim 1, comprising prior to step (a):

installing a nozzle plug in the nozzle.

6. The method of claim 5, wherein step (a) further comprises:

pumping a wash-in fluid though the annulus to remove debris in the annulus.

7. The method of claim 6, wherein the nozzle plug is comprised of dissolvable material, and further comprising after step (a) and before step (c):

dissolving the nozzle plug.

8. The method of claim 6, wherein the nozzle plug is comprised of a low-melt temperature plastic, and further comprising after step (a) and before step (c):

melting the nozzle plug.

9. The method of claim 5, further comprising:

adding a consolidation agent to the fracturing fluid.

10. The method of claim 9 wherein the consolidation agent is a resin coated proppant.

11. The method of claim 1 further comprising:

adding a propping agent to the fracturing fluid; and propelling the propping agent into the cavities.

12. The method of claim 1 further comprising following step (d):

displacing the fracturing fluid with an acid.

13. The method of claim 1 wherein the liner fracturing tool further comprises a port and further comprising a jet holder, the jet holder mounted within the port, wherein the jet is axially mounted within the jet holder, and further comprising following step (d):

(e) dissolving the jet holder; and (f) allowing hydrocarbons to flow into the fluid passageway.

14. The method of claim 13 wherein the jet holder is dissolved with acetic, formic, hydrochloric, hydrofluoric and fluroboric acids.

15. The method of claim 13, further comprising following step (d):

(e) decomposing the jet holder.

16. The method of claim 1, further comprising following step (d):

packing the wellbore by introducing a fluid slurry into the annulus.

17. The method of claim 16, wherein the fluid slurry comprises gravel.

* * * * *